US005307565A

United States Patent [19]

Erbrick et al.

[11] Patent Number: 5,307,565

[45] Date of Patent: May 3, 1994

[54] HAND TOOL WITH RATCHET ACTION JAMS

[75] Inventors: Robert S. Erbrick, Danboro; Joseph E. Erbrick, Jr., Chalfont, both of Pa.

[73] Assignee: Electroline Corp., Danboro, Pa.

[21] Appl. No.: 987,527

[22] Filed: Dec. 4, 1992

Related U.S. Application Data

[63] Continuation-in-part of Ser. No. 864,162, Apr. 2, 1992, Pat. No. 5,195,353, which is a continuation of Ser. No. 718,057, Jun. 20, 1991, abandoned.

[51] Int. Cl.[5] ..... B26B 13/00

[52] U.S. Cl. ..... 30/251; 30/250

[58] Field of Search ..... 30/199, 192, 193, 250, 30/251, 252, 244, 92; 81/314, 33 D, 34 D

[56] References Cited

U.S. PATENT DOCUMENTS

| | | | |
|---|---|---|---|
| 160,563 | 3/1875 | Billings | 30/251 |
| 510,897 | 12/1893 | Crook | 81/309 |
| 938,627 | 11/1909 | Arneson | 30/251 |
| 1,250,690 | 12/1917 | Stallings . | |
| 1,413,453 | 4/1922 | Brassell . | |
| 1,498,488 | 6/1924 | Stallings . | |
| 2,086,400 | 7/1937 | Brenizer . | |
| 2,216,152 | 10/1940 | Becker | 72/35 |
| 2,415,896 | 2/1947 | Marsh | 72/410 |
| 2,787,925 | 4/1957 | Buchanan et al. . | |
| 3,120,772 | 2/1964 | Mixon | 72/410 |
| 3,216,291 | 11/1965 | Madeira . | |
| 3,257,874 | 6/1966 | Madeira . | |
| 3,263,535 | 8/1966 | Zurcher . | |
| 3,330,148 | 7/1967 | Hornung | 72/410 |
| 3,688,553 | 9/1972 | Demler | 72/410 |
| 4,136,549 | 1/1979 | Lytle et al. . | |
| 4,178,682 | 12/1979 | Sadauskas | 30/251 |
| 4,223,439 | 9/1980 | Rommel | 30/250 |
| 4,480,460 | 11/1984 | Bush et al. . | |
| 4,899,445 | 2/1990 | Erbrick et al. | 30/251 |
| 4,934,172 | 6/1990 | Bush | 72/410 |
| 5,184,404 | 2/1993 | Chen | 30/249 |

OTHER PUBLICATIONS

Burndy catalog Section B, p. 80, "Type My Dieless Hytool".

Burndy catalog Section H, p. 94, "Type 0H25 Hytool One-Hand Operation, Dieless, Full Cycle Ratchet Tool".

Thomas & Betts catalog p. C 96, "Smart ® Universal Die 12 Ton Hydraulic Head".

Rota-Crimp catalog page, "Heavy Duty Bantam Rota-Crimp tool for Heavy Duty Solistrand terminals" and Rota-Crimp tool for Uninsulated terminals and splice for 8-4/0 AWG wire sizes.

*Primary Examiner*—Richard R. Seidel

*Assistant Examiner*—Hwei-Siu Payer

*Attorney, Agent, or Firm*—Panitch, Schwarze, Jacobs & Nadel

[57] ABSTRACT

A hand operated ratchet tool includes first and second pivotally coupled jaws, first and second links pivotally coupled to the first and second jaws, respectively, a third link pivotally coupled in common with the first and second links, and first and second handles pivotally coupled with the first and third links, respectively, and with one another. First and second pawls are mounted on the pivots between the third link and second handle and between the first link and first handle, respectively. Each alternately engage with teeth provided along a semi-circular edge of the second link to rotate the second link in a direction which closes the adjoining working faces of the jaws. The first pawl has two separate sets of teeth configured to respectively engage with the link teeth when the second link is being rotated in either of two opposing directions to open and close the jaws. A selector mechanism permits selective engagement of either sets of teeth of the first pawl and engagement and disengagement of the second pawl with the link teeth. A pivot adjustment is provided to take up slack in the linkage from wear of the parts.

19 Claims, 5 Drawing Sheets

HAND TOOL WITH RATCHET ACTION JAMS

RELATED APPLICATION

This is a continuation-in-part of U.S. patent application Ser. No. 07/864,162 filed Apr. 2, 1992, now U.S. Pat. No. 5,195,353, which is a continuation of application Ser. No. 07/718,057 filed Jun. 20, 1991, now abandoned.

FIELD OF THE INVENTION

The present invention relates to hand tools and, in particular, to hand tools having jaws which can be progressively opened and closed by ratcheting action.

BACKGROUND OF THE INVENTION

U.S. Pat. No. 4,899,445 discloses a ratchet action cable cutter which includes a first jaw pivotally coupled to a first actuating handle, a second jaw pivotally coupled to the first jaw and a link pivotally coupled with the two jaws on a common pivot. The link is further pivotally coupled to a second handle. The second jaw has a toothed, semi-circular side. A pawl with two opposing sets of teeth is pivotally supported on the link. The pawl can be pivoted to selectively engage with the teeth of the second jaw teeth in either rotational direction of the second jaw.

While this tool represented a significant improvement over other existing wire cutters and ratchet-action jaw equipped hand tools known at the time, it has been found possible to further improve the performance of this tool.

SUMMARY OF THE INVENTION

In one aspect, the present invention is a hand tool comprising a first jaw having first and second ends; a second jaw having first and second ends, the first and second jaws being pivotally coupled together with the first and second ends. The tool further comprises a first link having a first end pivotally coupled with the second end of the first jaw; and a second link having a first end pivotally coupled with the second end of the second jaw. The tool further comprises a first handle having a first end pivotally coupled with the second end of the first link; a second handle pivotally coupled with the first handle; and a third link having a first end pivotally coupled in common with the first and second links on a link pivot and a second end pivotally coupled with the second handle.

In another aspect, the invention is a hand tool comprising a first link having first and second opposing ends; a second link coupled with the first link on a link pivot, the second link including a curved surface at least generally radiused with respect to the link pivot and supporting a plurality of teeth; and a third link coupled in common with the first and second links on the link pivot. The tool further comprises a first handle having a first end pivotally coupled with the second end of the first link; a second handle pivotally coupled with the first handle and with the second end of the third link; a first pawl positioned to engage the link teeth at least while the second link is pivoting in a first direction about the link pivot; and a second pawl separate and apart from the first pawl and positioned to engage the link teeth at least while the second link is pivoting in the first direction about the link pivot.

BRIEF DESCRIPTION OF THE DRAWINGS

The foregoing summary as well as the following detailed description, will be better understood when read in conjunction with the appended drawings. For the purpose of illustrating the invention, there is shown in the drawings embodiments which are presently preferred. It should be understood, however, that the invention is not limited to the specific methods, arrangements, and instrumentalities shown. In the drawings.

DETAILED DESCRIPTION OF PREFERRED EMBODIMENT

Figure 1:
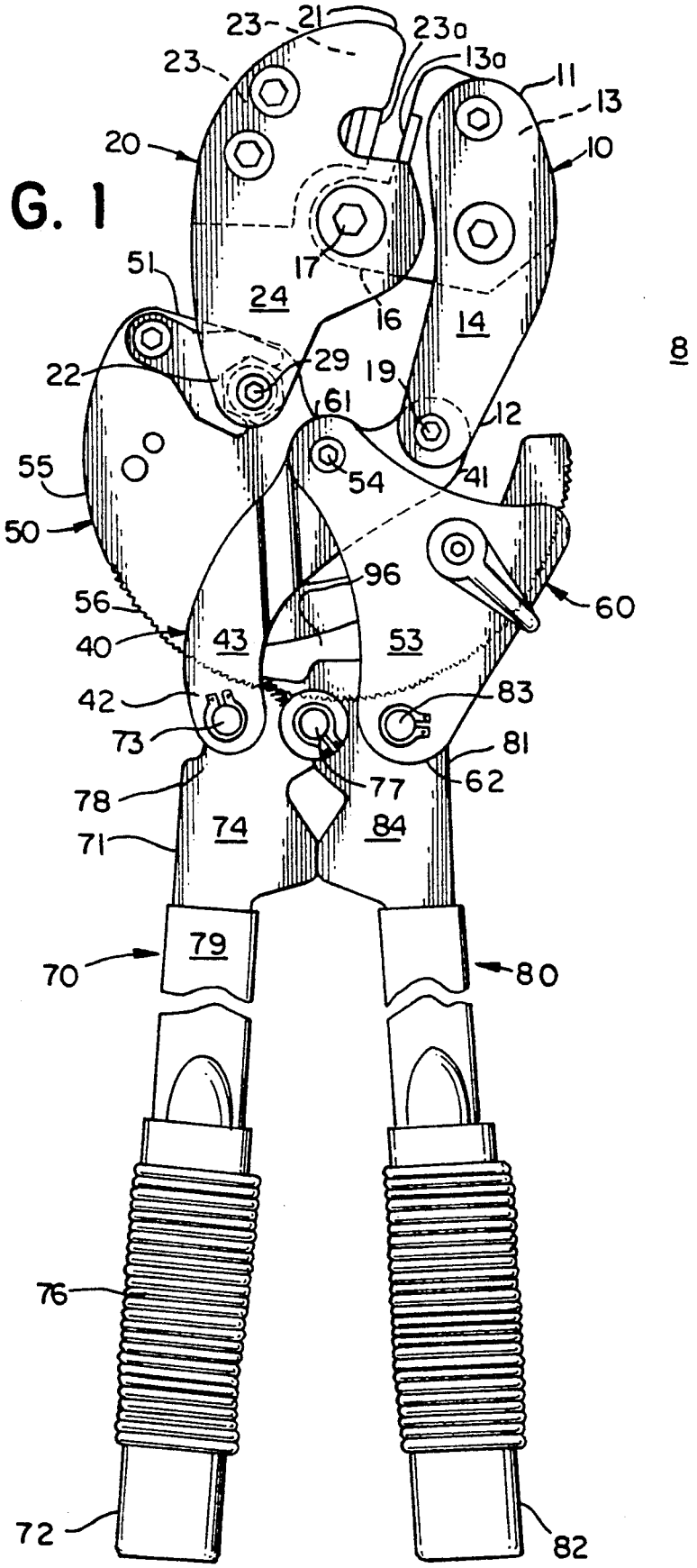
FIG. 1 is a front elevational of a hand-actuated ratchet tool in accordance with the present invention with a first pair of cutting jaws, the tool being configured to ratchet open.

Certain terminology is used in the following description for convenience only and is not limiting. The terms "right," "left," "lower," "upper" designate directions in the drawings to which reference is made. The words "inwardly" and "outwardly" refer to directions towards and away from, respectively, the geometric center of the tool and/or designated parts thereof. The terminology includes the words specifically mentioned above, derivatives thereof, and words of similar import.

In the various figures, like numerals are used to indicate the same elements throughout. There is shown in FIGS. 1–4, a presently preferred embodiment of a hand-actuated ratchet action tool, indicated generally at 8, which is configured as a cutter. Briefly, tool 8 includes first and second cutting jaws indicated generally at 10 and 20, first, second and third links indicated generally at 40, 50 and 60, and first and second handles indicated at 70 and 80. The jaws 10 and 20 are opening in FIGS. 1 and 2 and fully closed in FIGS. 3 and 4. In many respects, tool 8 is similar to the tool of U.S. Pat. No. 4,899,445, which is incorporated by reference herein in its entirety.

First and second cutting jaws 10 and 20 preferably have first ends 11 and 21, respectively, which generally adjoin one another, and second ends 12 and 22, respectively, which generally adjoin one another and oppose the first ends 11 and 21, respectively. Preferably, the first jaw 10 is provided with a cutting die 13 having a cutting edge 13*a* at the first end 11. Die is sandwiched between a pair of identical, parallel, spaced-apart jaw plates 14. The second jaw 20 similarly includes its own cutting die 23 with cutting edge 23*a* at first end 21, facing edge 13*a*. Die 23 is sandwiched between identical, parallel, first and second jaw plates 24. The cutting die 13 of the first jaw 10 preferably includes a leg portion 16 which extends between the second jaw plates 24. The jaws 10 and 20 preferably are pivotally coupled together, with the first ends generally adjoining one another so as to be reciprocated together and apart, by the provision of a suitable pivot 17 extending transversely through the overlapping portions of the leg 16 and jaw plates 24 between the ends 11/12 and 21/22.

Preferably, each of the jaws 10 and 20 is further pivotally coupled to the main body of the hand tool 8. In particular, second end 12 of first jaw 10 is rotatably coupled to a first end 41 of a first link 40 by a suitable pivot 19. Second end 22 of the second jaw 20 is also rotatably coupled to a first "end" 51 of a second link 50 by a suitable pivot 29. Link pivots 19 and 29 are preferably located farther from jaw pivot 17 than are cutting edges 13*a* and 23*a* so as to magnify the force being applied through the second ends 12 and 22 of the jaws 10 and 20 to the cutting edges 13*a*, 23*a*, which constitute the working surfaces of tool 8.

Figure 5:
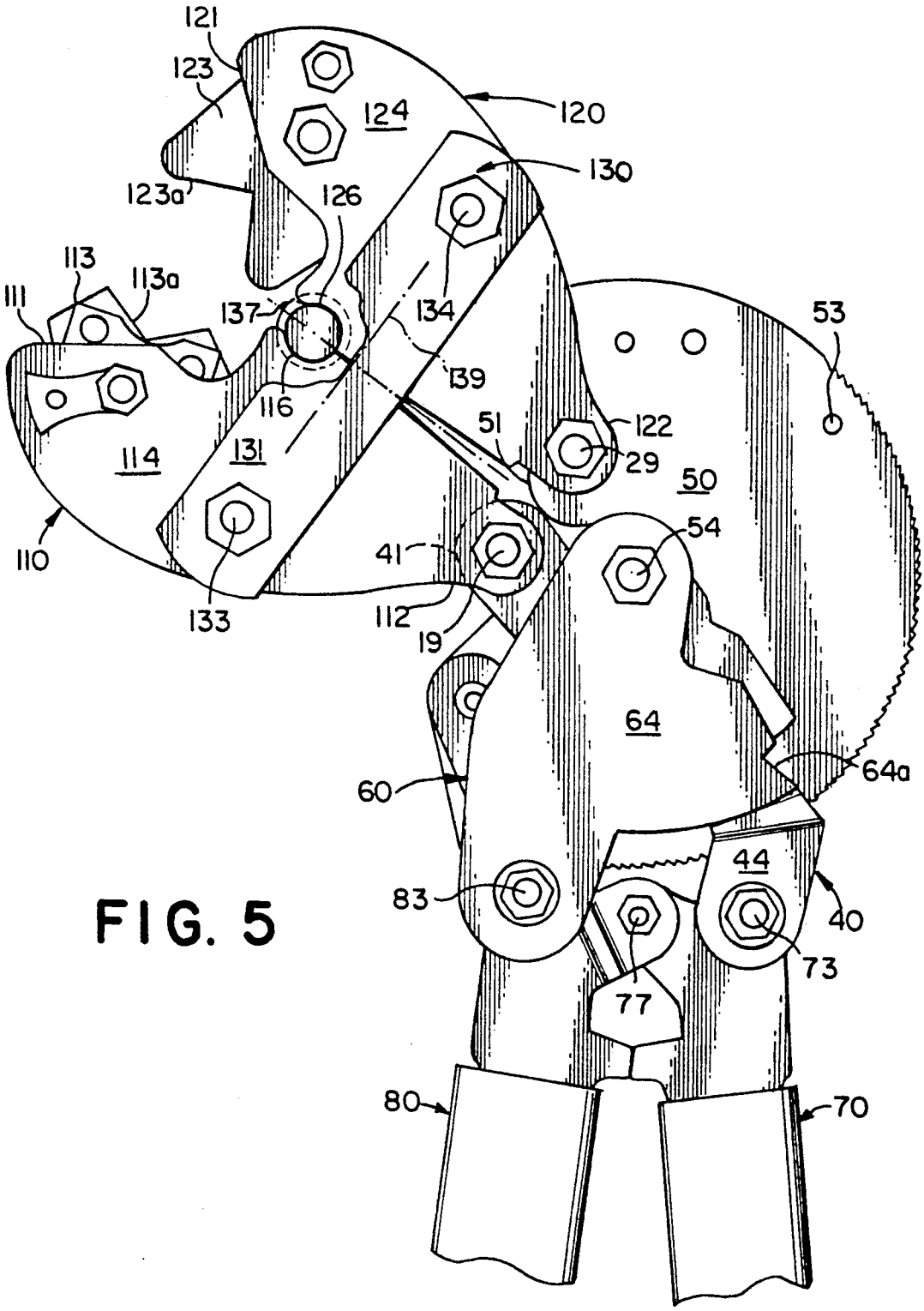
FIG. 5 is a rear elevation of a tool like the tool of FIGS. 1–4 but in a fully opened configuration and mounting a different jaw head with a pair of crimping jaws.

Preferably the first link 40 is collectively provided by a pair of separate, generally parallel acting members 43, 44 while the second link 50 is provided by a single plate bearing the same reference numeral, which is sandwiched between the pair of members 43 and 44. Third link 60 is further preferably collectively provided by a pair of generally parallel acting members 63 and 64. Members 44 and 64 are depicted in FIG. 5. Preferably members 63 and 64 overlap opposing sides of the plate 50 defining the second link 50 and further overlap the first and second members 43 and 44 at the first end 41 of the first link 40. The three links 40, 50 and 60 are all rotatably coupled in common on a link pivot 54, which passes transversely through each of the members or plates 43, 44, 50, 63 and 64. Link pivot 54 is located generally at the first end 61 of the third link 60 and at the center of a curved, outer edge 55 of the second link 50, which is preferably radiused with respect to the link pivot 54. A plurality of teeth 56 are provided along part and preferably along at least a semicircular portion of the curved outer edge 55.

First handle 70 has opposing first and second longitudinal ends 71, 72. First end 71 of the handle is provided by a U-shaped or clevis-like member 78, which is forked to provide a pair of spaced, generally symmetric legs 74 and 75. The clevis-like member 78 is received in one end of a tubular member 79, which is crimped to retain member 78. A handgrip 76 is preferably provided at the second end 72 on member 79. The second handle 80 has opposing first and second longitudinal ends 81, 82 and is of identical construction as first handle 70.

The first end 71 of the first handle 70 is received between plates 43, 44 collectively defining the first link 40 and is rotatably coupled to the second end 42 of first link 40 by a suitable pivot 73. In a like fashion, the first end 81 of the second handle 80 is received between plates 63 and 64 collectively defining third link 60 and is rotatably coupled with the second end 62 of third link 60 by a suitable pivot 83. Preferably the pairs of spaced-apart legs 74, 75 and 84, 85, respectively, defining the first ends 71, 81 of handles 70, 80, are overlapped with one another and are rotatably coupled together by a suitable pivot 77. A journal 87 can be provided between the immediately adjoining legs 85, 75 to maintain spacing (FIG. 2).

Figure 2:
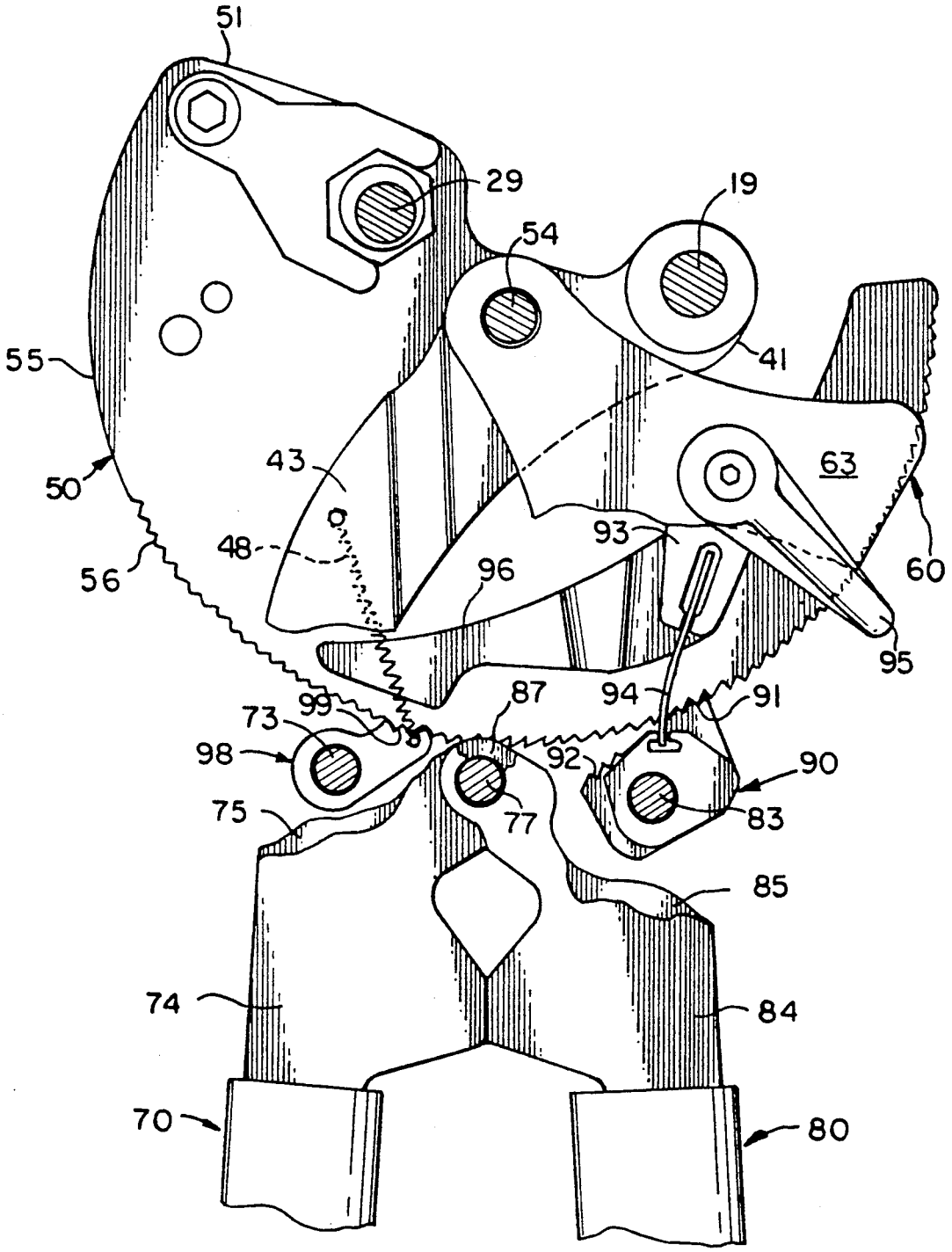
FIG. 2 is a detailed, partially broken away front elevational of the tool FIG. 1 depicting details of the ratchet drive in the jaw opening configuration.
Figure 4:
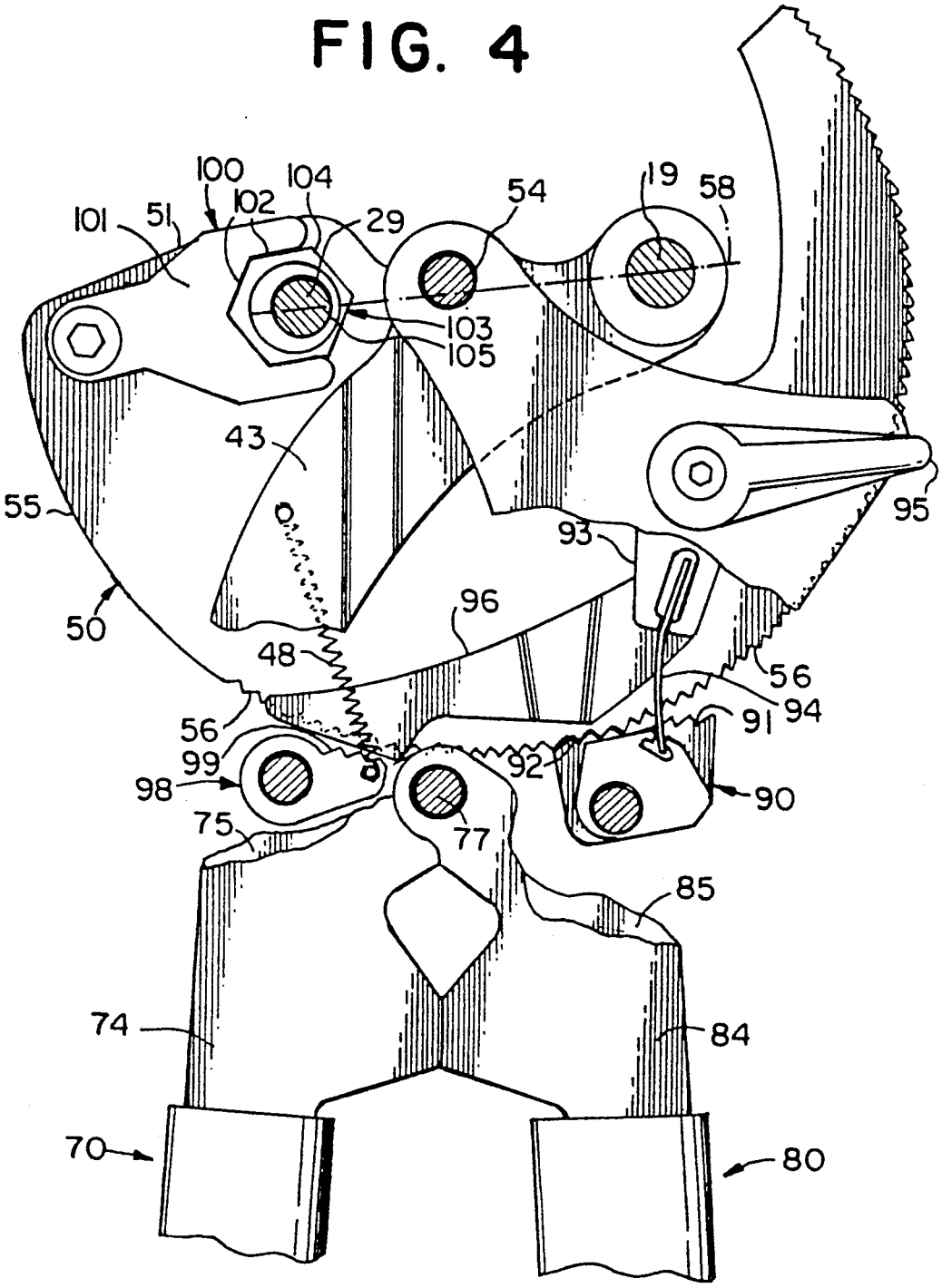
FIG. 4 is a detailed, partially broken away front elevation of the tool of FIG. 3 depicting details of the ratchet drive in the jaw closing configuration.

FIGS. 2 and 4 reveal details of preferred ratchet drive to reciprocate the second link 50 to open and close jaws 10, 20. The preferred drive includes first and second pawls 90 and 98, respectively. Preferably, first pawl 90 is mounted between the legs 84, 85 of the second handle 80, to rotate about pivot 83, which further couples the third link 60 and the second handle 80. First pawl 90 has at least one tooth and preferably a first set of teeth 91 at one end and at least one tooth and preferably a second set of teeth 92 at an opposing end. Each set of teeth 91, 92 may be selectively biased into engagement with teeth 56 of the second link 50 for selectively driving the first end 51 of the second link 50 away from and towards the first end 41 of the first link 40 to respectively close and open the first ends 11 and 21 of the first and second jaws 10, 20. Second pawl 98 has at least one tooth and preferably a set of teeth 99 configured to engage the link teeth 56. Second pawl 98 is preferably positioned separate and apart from the first pawl 90, and preferably pivotally mounted between legs 74, 75 of the second handle 70 and the plate members 43, 44 of first link 40 to rotate on the pivot 73, which also couples the first link 40 and first handle 70 together.

Preferably, a selector is provided in conjunction with the pawls 90, 98 for selectively engaging the first or second set of teeth 91, 92 of the first pawl 90 and engaging or disengaging teeth 99 of the second pawl 98 with link teeth 56. The preferred selector is a mechanism which comprises an inner, generally rigid lever 93, a resiliently flexible biasing member 94, which is coupled with and extends between the lever 93 and pawl 90, an external, generally rigid lever 95, which is fixedly coupled to the inner lever 93 for common rotation, a biasing tension spring 48 and a foot 96. External lever 95 can be rotated by a user of the tool 8 to rotate pawl 90 to selectively engage first teeth 91 or second teeth 92 of pawl 90 with link teeth 56. One end of tension spring 48 is preferably attached to member 43 of the first link 40 while an opposing end is coupled with the second pawl 98. Spring 48 normally biases second pawl 98 to rotate to engage teeth 99 with the link teeth 56. Foot 96 is preferably fixedly coupled with inner rigid lever 93 to rotate with that lever. Foot 96 is sufficiently long to contact second pawl 98, when the inner lever 93 is at its extreme, counter-clockwise position shown in FIGS. 3 and 4, and to rotate the pawl 98 to disengage teeth 99 from link teeth 56.

Operation of the tool 8 will now be described with respect to FIGS. 1–4. In FIG. 1, jaws 10 and 20 of the tool 8 are partially open while the external lever 95 of the selector mechanism is positioned at its extreme clockwise position. This engages the first set of teeth 91 of first pawl 90 and the teeth 99 of second pawl 98 with the link teeth 56 to rotate the second link 50 in a first, counter-clockwise direction around the link pivot 54, thereby spreading link ends 41, 51 and closing jaw first ends 11, 21. In this configuration, when the handles 70 and 80 are reciprocated apart or spread, teeth 99 of the second pawl 98 engage link teeth 56 and hold the second link 50 in a generally fixed position with respect to the first link 40. This permits the third link 60 to move in a clockwise direction around the link pivot 54 towards the first link 40 while first set of teeth 91 ratchet over the link teeth 56. When the handles 70, 80 are reciprocated together, the first teeth 91 engage with the link teeth 56 and hold the second link 50 generally stationary with respect to the third link 60 and permit the first link 40 to rotate generally clockwise with respect to the second link 50, away from the third link 60, while teeth 99 of the second pawl 98 are permitted to ratchet over the link teeth 56. In this way, teeth 91 and 99 alternately engage the link teeth 56 during counter-clockwise movement of the second link 50 to provide jaw closure. As the first ends 41 and 51 of the first and second links are spread in this fashion, the first ends 11 and 21 of the jaw 10 and 20 are caused to pivot together, ultimately bringing the cutting edges 13*a* and 23*a* into abutting contact, as shown in FIG. 3.

Figure 3:
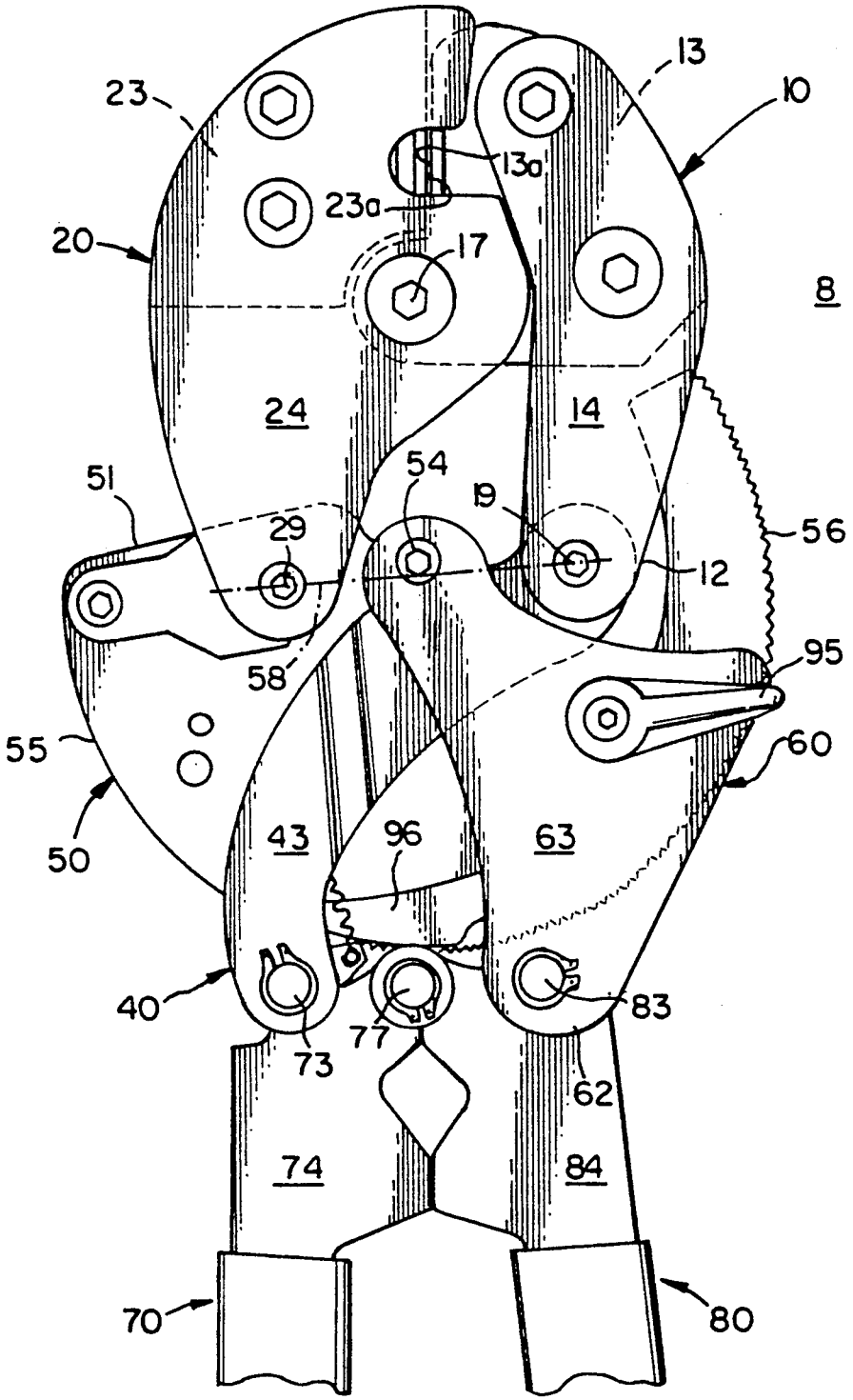
FIG. 3 is a front elevational of the tool of FIGS. 1 and 2 in a fully closed configuration.

To open the jaws 10, 20 from this or any other position, the external lever 95 of the selector mechanism is rotated counter-clockwise from the position indicated in FIGS. 1 and 2 to the position shown in FIGS. 3 and 4, thereby rotating inner lever 93, biasing member 94 and foot 96. Biasing member 94 causes pawl 90 to rotate in a clockwise direction, thereby disengaging the first teeth 91 from link teeth 56. Member 94 biases the second teeth 92 into engagement with link teeth 56. The same rotation causes foot 96 to pivot counter-clockwise and contact second pawl 98, rotating the pawl 98 counter-clockwise and disengaging its teeth 99 from link teeth 56.

In this configuration, when handles 70 and 80 are spread, the second link 50 simultaneously rotates and displaces radially towards pivot 83 and towards the second teeth 92, bringing teeth 56 into engagement with teeth 92. Further movement of the second link 50 with respect to the first pawl 90 biases the first pawl 90 clockwise and raises teeth 92 into further engagement with teeth 56. The two sets of teeth 56, 92 will lock and prevent any further counter-clockwise movement of the second link 50 with respect to the third link 60 while the handles 70, 80 are spread. When the handles 70, 80 are reciprocated together, drag in the linkage causes second link 50 to move clockwise around pivot 83, rotating the pawl 90 counter-clockwise and permitting the second teeth 92 to disengage from and ratchet over the link teeth 56.

An important aspect of this invention is the provision of a second toggling joint among pivots 19, 29 and 54 in addition to the toggle joint provided between handles 70, 80 by pivots 73, 77, 83. Handles 70, 80 provide the same toggle joint and toggling action provided by the handles in the prior U.S. Pat. No. 4,899,445, in that during each closure of the handles, pivot 77 moves between pivots 73 and 83 spreading the second ends of links 40, 60. If desired, handles 70, 80 can be made to self-lock by assuring that pivot 77 crosses the centerline between pivot 73 and 83 at full closure of the handles 70, 80. This toggling action of the handles 70, 80 is intended to multiply the force applied to the links 40, 60 in the vicinity of the pawls 90, 98.

Preferably, pivots 19, 29 and 54 provide a second similar toggling action at the second ends 12, 22 of the jaws. As the first ends 11, 21 of the jaws 10, 20 close, pivots 19 and 29 move apart, though less and less during each successive stroke of the handles 70, 80, while pivot 54 at least approaches and, preferably, crosses the centerline 58 between the pivots 19, 29 to provide an over-centering locking action. This provides an additional mechanical advantage at the working surfaces 13*a*, 23*a* and the jaws 10, 20 at full closure. Over-centering movement of the pivot 54 between the pivots 19 and 29 when the jaws are fully closed is further preferred as it unloads the pawls 90, 98 and thereby assists in the reversal of their position to reopen the jaws. Movement of link pivot 54 more than slightly over the centerline 58 between the first and second jaw pivots 19 and 29 is prevented by the engagement of pin 53 protruding from a rear side of link 50 and a suitably positioned stop surface 64*a* on member 64 of link 60 (see FIG. 5).

The provision of the second pawl 98 in the present tool also adds a significant benefit, particularly when the tool is being used to work on an extremely resilient member or work piece such as guy wire or other resilient cabling. It was found when an extremely resilient work piece was being cut with the tool of U.S. Pat. No. 4,899,445 that the jaws of that tool could be forced apart by the resilience of the work piece when the lever arms were spread to take up on the ratchet. This could prevent the jaws from being closed together any further and completing the cut. Second pawl 98 now provides a positive engagement with the second link 50 when the handles 70, 80 are being spread and the jaws are being closed to prevent the backlash arising with the use of the tool of U.S. Pat. No. 4,899,445.

Another important improvement over the tool of U.S. Pat. No. 4,899,445 is an adjustment mechanism which allows slack in the linkage between the jaws and handles, which will inevitably arise with use and wear, to be taken up to assure continued full closure of the cutting edges 13*a*, 23*a*. Wrench 100 is releasably mounted to the second link 50 and includes a fork 101 with plural flat sides 102. Fork 101 is engaged with an adjustable bushing 103. Bushing 103 is mounted to second link 50 between plate 24 and a second plate (unnumbered), which is hidden behind plate 24 in the figures and which defines with plate 24 the second jaw 20. The bushing 103 includes a polygon shaped outer surface 104 shaped to matingly engage surfaces 102 of the fork 101. Bushing 103 includes an eccentrically positioned bore 105, which receives the member constituting pivot 29. With use, the pivotally coupled components will tend to wear and loosen, preventing full compressive closure of the working edges 13*a*, 23*a* of the jaws. Bushing 103 can be rotated to reposition the eccentrically positioned bore 105 and change the positioning between the second link 50 and the second jaw 20, thereby taking up slack in the linkage, handles and jaws and permitting full closure of the working edges 13*a*, 23*a* of the jaws. While hexagonal shapes are depicted for the outer surface 104 of bushing 103 and the surfaces 102 of fork 101, other polygonal shapes may be used, providing finer or coarser adjustment.

Referring now to FIG. 5, the links 40, 50 and 60 and handles 70 and 80 are shown together with a different working head formed by a first crimping jaw 110, a second crimping jaw 120 and a jaw bridge 130, which provides a non-overlapping type of toggle coupling between the jaws 110 and 120. Preferably, the first crimping jaw 110 has first and second opposing ends 111 and 112 and a crimping die 113 which is held between a pair of opposing, preferably identical jaw plates 114. Preferably, the second crimping jaw 120 similarly includes a crimping die 123 at a first end 121 of the jaw 120, which is fixedly coupled between a pair of opposing, identical jaw plates 124. The second end 112 of the first jaw 110 is pivotally coupled to the first end of the first link 40 at first pivot 19 and the second end 122 of the second jaw 120 is pivotally coupled to the second link 50, at second pivot 29, identically to the manner in which the first and second jaws 10 and 20 of the embodiment of FIGS. 1–4 are attached to those links 40 and 50, respectively.

Preferably, jaw bridge 130 is formed by a pair of parallel, identical bridge plates 131 on opposing sides of the jaws 110, 120. Each jaw 110 and 120 is pivotally coupled to the jaw plates 131 by suitable pivots 133, 134. Bushings (not depicted) may be provided between the jaw plates 131 to maintain lateral stability of the working head through the pivots 133, 134.

In an important aspect of this embodiment of the invention, a third toggle joint is created between the first and second jaw members 110, 120 by the provision of a third pivot 137 between the first and second jaw members 110 and 120 in the form of a generally cylindrical bearing member with the same reference numeral 137. Bearing member 137 is received between generally semi-circular cutouts 116 and 126 in the plates 114 and 124 on adjoining faces of the first and second jaws 110 and 120, respectively, between the bridge plates 131. The bearing member 137 moves generally perpendicularly with respect to a center line 139 between pivots 133, 134 as the first ends 41 and 51 of links 40, 50 move apart, bringing the first ends 111 and 121 of the jaws 110, 120 together. Preferably, the cylindrical bearing member 137 is made to move over center between bridge pivots 133, 134, away from the first ends 111 and 121 and towards the second ends 112, 122 of the jaws at full jaw closure. The bearing member 137 is placed under compression by the jaws 110, 120 and pivots 133, 134 when approaching centerline 139 as the dies 113, 123 approach full closure. This over-center toggling action of the bearing member 137 further magnifies the force supplied by links 40, 50 to the working faces of 113*a*, 123*a* of the crimping dies 113, 123 as they come together, beyond the simple lever advantage provided by locating the pivots 19, 29 farther from jaw pivots 133, 134 than the crimping surfaces 113*a*, 123*a* are located. If desired, a similar pivotal mounting can be provided between the jaws 10 and 20 of the embodiment of FIG. 1, and vice-versa.

The provision of a separate pair of jaws pivotally coupled with one another and with the ends of the first and second links increases the mechanical advantage of the tool significantly at the working jaw surfaces 13*a*, 23*a* and 113*a*, 123*a*. However, the most significant advantage is provided from the toggle action among the links 40, 50, 60 at the pivots 19, 29, 54. The toggle action from these pivots results in an additional mechanical advantage. As the jaws of the tools (any style) close, pivots 19 and 29 move apart less and less during each successive handle stroke, thereby increasing the mechanical advantage. Now, not only is the ratchet driven by the toggle jointed handles, but the ratchet now drives the toggle joint as well. It will be appreciated that any system of links that is currently driven by a toggle and ratchet, for example like that in prior U.S. Pat. No. 4,899,445, can now be used to drive an additional toggle. Furthermore, any system of links that provide a toggle joint can now be driven by a ratchet in conjunction with the toggle.

The mechanical advantage provided by this coupling permits relatively short (about one foot) handles to be used in place of handles two to three feet long, which would be necessary to achieve the same mechanical advantage at the jaws of the tool disclosed in U.S. Pat. No. 4,874,445. The compact size of the tools of the present invention more than compensates for what might possibly be considered a slight inconvenience due to the rotation of the jaw head slightly around the links during opening and closing of the jaws. Tools of the present invention are extremely useful in working in cramped quarters around machinery, within pipes or manholes, etc.

One of ordinary skill would appreciate that while a toggle type pivot has been provided between the jaws of the tools of the present invention, the invention can be used with virtually all other forms of jaw couplings (e.g. simple or compound, toggle or scissor, etc.) and for virtually all other types of jaw functions (e.g. gripping, punching, spreading, etc.). Preferably, each of the various pivots 17, 19, 29, 54, 73, 77, 83, 133 and 134 is provided by a conventional fastening device such as a rivet, bolt with nut, pin with split-ring fastener, cotter pin, etc., which acts not only as a pivot but further secures together the various elements of the tool overlapping at the pivot. While not specifically described and disclosed in detail, one of ordinary skill will appreciate that journals, washers and/or sleeves can be provided along such pivots to reduce wear and/or take-up any space which may exist between various members which are overlapped on the pivot for rotation. It will also be appreciated that the linkage and selector mechanism can be covered with a protective boot, if desired.

It will further be appreciated that the pawls can be repositioned and that separate pawls can actually be substituted for the first pawl and its two sets of teeth. It will further be appreciated that other mechanisms can be provided for selectively engaging either set of teeth of the first pawl and/or engaging and disengaging the second pawl from the link teeth, including separate selectors for the two pawls. It will further be appreciated that other types of members can be provided to bias either pawl towards or away from the link teeth. It will further be appreciated that although link teeth are conveniently provided along an outer peripheral edge of the second link, teeth could also be provided within a slot or a groove formed in the body of the link or it could even project transversely from a major plane of the link. It will further be appreciated that although plural plates 43, 44 and 63, 64 are preferred, that single plates could be provided. Similarly, the jaws may be of a one-piece rather than multi-piece construction as shown and/or two or more of the selector components 93, 94, 95 and/or 96 can be combined into a single element performing the same function as the combined components.

While preferred embodiments have been described and certain modifications thereto disclosed, one of ordinary skill will appreciate that still other modification could be made to the described embodiments of the invention without departing from the broad inventive concepts thereof. It is to be understood, therefore, that the present invention is not limited to the particular embodiments disclosed, but is intended to cover all modifications which are within the scope and spirit of the invention, as defined by the appended claims.

We claim:

1. A hand tool comprising:

a first jaw having first and second ends;

a second jaw having first and second ends, the first and second jaws being pivotally coupled between the first and second ends;

a first link having a first end pivotally coupled with the second end of the first jaw;

a second link having a first end pivotally coupled with the second end of the second jaw;

a first handle having a first end pivotally coupled with the second end of the first link;

a second handle pivotally coupled with the first handle; and a third link having a first end pivotally coupled in common with the first and second links on a link pivot and a second end pivotally coupled with the second handle.

2. The tool of claim 1 wherein the second link has a curved edge at least generally radiused with respect to the link pivot and supporting a plurality of teeth; and the tool further comprises a first pawl drivingly engaging the link teeth at least while the second link is pivoting in a first rotational direction about the link pivot.

3. The tool of claim 2 further comprising a second pawl separate and spaced apart from the first pawl drivingly engaging the link teeth at least while the second link is pivoting in the first rotational direction about the link pivot, said first and second pawls being positioned to alternately engage the link teeth as the first and second handles are reciprocated together and apart.

4. The tool of claim 3 wherein each of the first and second pawls is pivotally mounted and further comprising a selector coupled with at least one of the first and second pawls so as to permit selective engagement and disengagement of the at least one of the first and second pawls with the link teeth.

5. The tool of claim 2 wherein the first pawl is pivotally mounted and has at least a first tooth and a second tooth and wherein the tool further comprises a bias member coupled with the first pawl so as to alternately bias the first tooth and the second tooth into engagement with the teeth of the second link in the first rotational direction and in a second, opposite rotational direction, respectively.

6. The tool of claim 5 further comprising a selector coupled with the first pawl so as to pivotally bias the pawl to selectively engage one of the first and second teeth with the link teeth.

7. The tool of claim 1 further comprising a linkage adjustment mechanism adjustably coupling at least one of the links with at least one of the jaws so as to selectively vary the position of the at least one of the links with respect the at least one of the jaws and to take up slack among the pivotably coupled links and jaws of the tool.

8. The tool of claim 1 wherein the first jaw and the first link are coupled by a first pivot, the second jaw and the second link are coupled by a second pivot and wherein the link pivot moves between the first and second pivots during closure of the jaws.

9. The tool of claim 8 wherein the link pivot passes over-center between the first and second pivots during closure of the first and second jaws.

10. The tool of claim 1 wherein the second link has a curved edge at least generally radiused with respect to the link pivot and supporting a plurality of teeth, said second handle has a first end pivotally coupled with said third link and the tool further comprises a first pawl mounted on the first end of said second handle and positioned to drivingly engage the link teeth at least while the second link is pivoting in a first rotational direction about the link pivot.

11. The tool of claim 10 further comprising a second pawl mounted on the first end of said first handle separate and spaced apart from the first pawl and positioned to drivingly engage the link teeth at least while the second link is pivoting in the first rotational direction about the link pivot.

12. A hand tool comprising:

a first link having first and second opposing ends;

a second link coupled with the first link on a link pivot, the second link including a curved surface at least generally radiused with respect to the link pivot and supporting a plurality of teeth;

a third link coupled in common with the first and second links on the link pivot;

a first handle having a first end pivotally coupled with the second end of the first link;

a second handle having a first end pivotally coupled with the first handle and with the second end of the third link;

a first pawl mounted on the first end of the second handle and positioned to drivingly engage the link teeth at least while the second link is pivoting in a first rotational direction about the link pivot; and a second pawl spaced from the first pawl and mounted on the first end of said first handle, said second pawl being positioned to engage the link teeth at least while the second link is pivoting in the first rotational direction about the link pivot, the first and second pawls being alternately biased into driving engagement with the link teeth as the first and second handles are reciprocated together and apart.

13. The tool of claim 12 further comprising a selector coupled with the first and second pawls so as to permit selective engagement and disengagement of at least one of the first and second pawls with the link teeth.

14. The tool of claim 12 wherein the first pawl has a least a first tooth and a second tooth and the tool further comprises a bias member coupled with the first pawl so as to alternately bias the first tooth and the second tooth into engagement with the teeth of the second link in the first rotational direction and in a second, opposite rotational direction, respectively.

15. The tool of claim 14 further comprising a selector coupled with the first pawl so as to pivotally bias the first pawl to selectively engage one of the first and second teeth with the link teeth.

16. The tool of claim 11 further comprising a lever and a linkage adjustment mechanism adjustably pivotably coupling at least one of the links with the lever so as to selectively vary the position of the at least one of the links with respect to the lever and to take up slack between the pivotally coupled link and lever.

17. The tool of claim 12 further comprising a first jaw having first and second ends, the second end of the first jaw being pivotally coupled with the first end of the first link; and a second jaw having first and second ends, the second end of the first jaw being pivotally coupled with the second link and the second jaw being pivotally coupled with the first jaw

18. The tool of claim 17 wherein the first jaw and the first link are coupled by a first pivot, the second jaw and the second link are coupled by a second pivot and wherein the link pivot moves between the first and second pivots during closure of the jaws.

19. The tool of claim 18 wherein the link pivot passes over-center between the first and second pivots during closure of the first and second jaws.

* * * * *